US008640939B2

(12) United States Patent
Ferrier

(10) Patent No.: US 8,640,939 B2
(45) Date of Patent: Feb. 4, 2014

(54) FASTENER DRIVING TOOL

(75) Inventor: Ian Ross Ferrier, Victoria (AU)

(73) Assignee: ITW Construction Systems Australia Pty Ltd, Victoria (AU)

( * ) Notice: Subject to any disclaimer, the term of this patent is extended or adjusted under 35 U.S.C. 154(b) by 198 days.

(21) Appl. No.: 12/865,208

(22) PCT Filed: Jan. 29, 2009

(86) PCT No.: PCT/IB2009/000162

§ 371 (c)(1),
(2), (4) Date: Jul. 29, 2010

(87) PCT Pub. No.: WO2009/095776

PCT Pub. Date: Aug. 6, 2009

(65) Prior Publication Data

US 2011/0006097 A1 Jan. 13, 2011

(30) Foreign Application Priority Data

Jan. 30, 2008 (AU) ..... 2008900410

(51) Int. Cl.
*B25C 1/12* (2006.01)
*B25C 1/14* (2006.01)

(52) U.S. Cl.
USPC ..... 227/10

(58) Field of Classification Search
USPC ..... 227/9–11; 173/2, 211
See application file for complete search history.

(56) References Cited

U.S. PATENT DOCUMENTS

| | | | | | |
|---|---|---|---|---|---|
| 3,060,440 | A | * | 10/1962 | De Caro et al. | 227/147 |
| 3,370,770 | A | * | 2/1968 | Henning et al. | 227/9 |
| 3,497,125 | A | * | 2/1970 | O'Brien | 227/10 |
| 3,549,074 | A | * | 12/1970 | Brunelle | 227/10 |
| 3,659,768 | A | * | 5/1972 | Brunelle | 227/10 |
| 3,690,536 | A | * | 9/1972 | Bakoledis | 227/10 |
| 3,786,977 | A | * | 1/1974 | Shamaly | 227/8 |
| 4,189,081 | A | * | 2/1980 | Combette et al. | 227/10 |
| 4,282,714 | A | * | 8/1981 | Fiocchi | 60/632 |
| 4,493,376 | A | * | 1/1985 | Kopf | 173/210 |
| 4,598,851 | A | * | 7/1986 | Kopf | 227/9 |
| 4,877,171 | A | * | 10/1989 | Almeras | 227/10 |
| 4,890,778 | A | * | 1/1990 | Hawkins | 227/10 |
| 5,269,450 | A | * | 12/1993 | Popovich et al. | 227/10 |
| 5,657,919 | A | * | 8/1997 | Berry et al. | 227/10 |
| 6,367,517 | B1 | * | 4/2002 | Hoermann | 141/67 |

OTHER PUBLICATIONS

ISR for PCT/IB2009/000162 dated Sep. 29, 2009.

* cited by examiner

*Primary Examiner* — Robert Long
(74) *Attorney, Agent, or Firm* — Lowe Hauptman & Ham, LLP

(57) ABSTRACT

An explosively actuated fastener driving tool of the type having a driving piston for driving a fastener at the forward end of a barrel upon firing of the tool has a retractor pawl assembly with a pawl for resetting the piston into a rear end of the barrel by forward movement of the barrel relative to the receiver following firing. The pawl assembly is so constructed that the pawl can be withdrawn from the barrel to permit removal of the barrel for routine cleaning and maintenance but in this condition the assembly still remains attached to the tool to prevent components from being misplaced.

14 Claims, 10 Drawing Sheets

FASTENER DRIVING TOOL

RELATED APPLICATIONS

The present application is national phase of PCT/IB2009/000162 filed Jan. 29, 2009, and claims priority from, Australian Application Number 2008900410 filed Jan. 30, 2008, the disclosures of which are hereby incorporated by reference herein in their entirety.

BACKGROUND OF THE INVENTION

1) Field of the Invention

The present invention relates to explosively actuated tools for driving fasteners such as nails or pins into a substrate composed of a relatively hard material such as concrete, masonry, or steel.

2) Description of the Prior Art

A typical explosively actuated driving tool comprises a barrel containing a piston which drives a fastener within a fastener guide at the forward end of the barrel upon firing of an explosive charge in a charge chamber at the rear of the barrel. The tool is cocked by pressing the forward end of the fastener guide against the substrate and when the tool is fired the piston is propelled along the barrel to drive the fastener into the substrate. The general construction and operation of tools of this type will be well understood by those skilled in the art and an example of a prior tool of this type is disclosed in U.S. Pat. No. 3,549,074.

After firing it is necessary to reset the piston to the rear of the barrel in preparation for the next firing. In order to achieve this the barrel is movably mounted within a receiver mounted to the tool housing which carries other components of the tool such as the trigger and firing mechanism. To reset the piston to the rear of the barrel after firing, the barrel is moved by hand forwardly relative to the receiver while the piston is retained relative to the receiver by a retractor pawl which is carried by the receiver and extends through a slot in the barrel to lie in front of a flange of the driving piston and thereby to prevent forwards movement of the piston when the barrel is moved forward.

Periodically, it is necessary to remove the barrel from the receiver for cleaning and maintenance and this, in turn, requires removal of the retractor pawl from the slot in the barrel. The retractor pawl is normally part of an assembly which is removed from the tool when it is required to remove the barrel. It is sometimes necessary for the barrel to be removed during use of the tool on a building site and in these circumstances it may happen that the retractor pawl assembly when removed from the tool is dropped or misplaced and, depending on its construction, individual components of the assembly may become displaced and lost.

SUMMARY OF THE INVENTION

According to the present invention, there is provided an explosively actuated fastener driving tool of the type having a driving piston for driving a fastener at the forward end of a barrel upon firing of the tool, and a retractor pawl assembly having a pawl extendible into the barrel for resetting the piston into a rear end of the barrel by forward movement of the barrel relative to the receiver following firing, the pawl assembly being so constructed that the pawl can be withdrawn from the barrel to permit removal of the barrel for cleaning and maintenance while the assembly remains attached to the tool to prevent components of the pawl assembly from being misplaced.

Further according to the present invention there is provided an explosively actuated fastener driving tool comprising a barrel mounted to a receiver of the tool, a driving piston within the barrel for driving a fastener at the forward end of the barrel upon firing of the tool, and a retractor pawl assembly for resetting the piston into a rear end of the barrel by forward movement of the barrel relative to the receiver following firing, wherein the retractor pawl assembly comprises a retractor pawl having a head extendible through a slot in the barrel to engage and retain the piston during forward movement of the barrel, the pawl being mounted in a housing fixed relative to the receiver and being spring biased to move radially into and out of the interior of the barrel by movement of the barrel relative to the receiver, and a release member operable to fully withdraw the pawl from the barrel to permit removal of the barrel from the receiver, the release member being mounted to the housing in such a manner that in a normal condition of the tool it cannot be moved to a position at which the pawl assembly is detached from the receiver.

In a preferred embodiment of the invention, the release member is a rotatable cap threadedly mounted to the housing, the pawl is linked to the cap such that the pawl is withdrawn from the barrel slot when the cap is unscrewed relative to the housing, and removal of the cap from the housing is prevented by engagement of the pawl with a stop on the housing as the cap is unscrewed. Preferably that stop is removable but only as a deliberate act using a tool to thereby facilitate disassembly in a workshop situation.

In an alternative, the cap may be mounted to the housing by a bayonet type fitting which retains the cap to the housing while allowing axial movement between the cap and the housing to remove the pawl from the barrel.

Particularly advantageously, in a ready-to-fire condition of the tool prior to cocking the tool, the pawl engages a detent in the barrel under its spring bias in order to prevent inadvertent forwards movement of the barrel from the receiver in this condition.

BRIEF DESCRIPTION OF THE DRAWINGS

An embodiment of the invention will now be described by way of example only with reference to the accompanying drawings in which.

DESCRIPTION OF THE PREFERRED EMBODIMENTS

Figure 2:
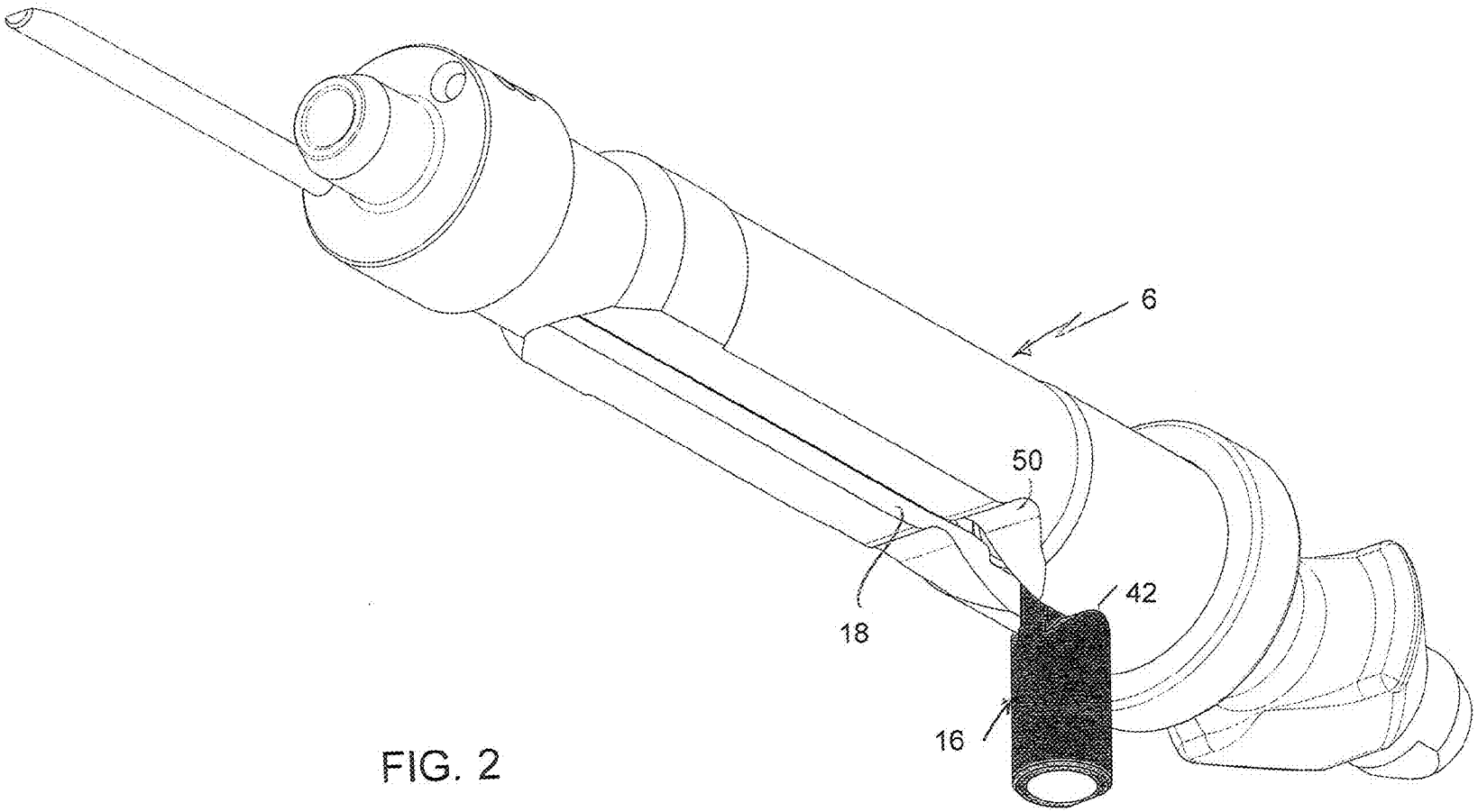
FIG. 2 is a schematic perspective view corresponding to FIG. 1 and showing the interaction between a retractor pawl and barrel in that condition.
Figure 3:
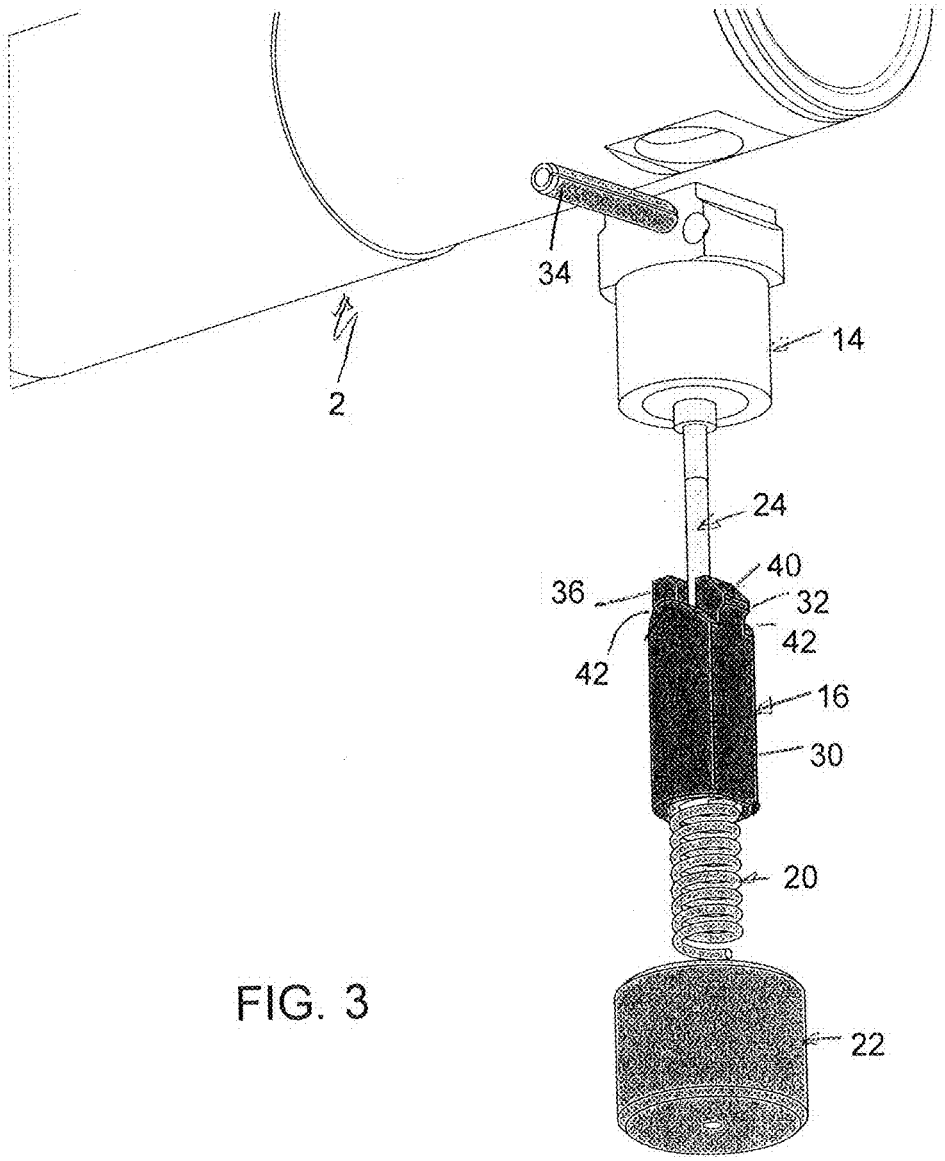
FIG. 3 is an exploded perspective view of the retractor pawl assembly.

An explosively actuated tool in accordance with a preferred embodiment of the invention is of the type described earlier. The improvement which forms the subject of this invention concerns the retractor pawl assembly previously discussed and as such only the forward end portion of the tool at which the retractor pawl assembly is mounted is shown in the drawings. With initial reference to FIGS. 1 to 3, there is shown the forward end portion of the tool including a receiver 2 fixably mounted within a housing 4 and a barrel 6 mounted within the receiver 2 for axial movement relative to the receiver in a fore-aft direction. The barrel 6 carries at its forward end a fastener guide 8. A driving piston 10 is mounted within the barrel 6, and, on firing the tool, is driven into the fastener guide 8 to drive a fastener at the forward end of the guide into a substrate. Apart from the construction and operation of the retractor pawl assembly, the tool is otherwise of conventional construction which will be well understood by those skilled in the art.

The retractor pawl assembly 12 comprises a housing in the form of a tubular spigot 14 fixed at the forward end of the receiver 2. A retractor pawl 16 is reciprocably mounted within the spigot 14 for movement perpendicularly to the axis of the barrel 6 (and thus radially of the barrel) between an inner position in which the inner end portion of the pawl 16 (its head) extends through an axial slot 18 in the barrel 6 into the interior of the barrel to retain the piston 10 during the resetting action, and an outer position in which its head is completely removed from the barrel to permit removal of the barrel from the receiver. The pawl 16 may also assume a variety of positions intermediate these extreme positions as will be described. The pawl 16 is biased towards its inner position by a compression spring 20 interposed between the pawl 16 and a release member in the form of a cap 22 which is threadedly mounted on the external surface of the spigot 14.

Figure 1:
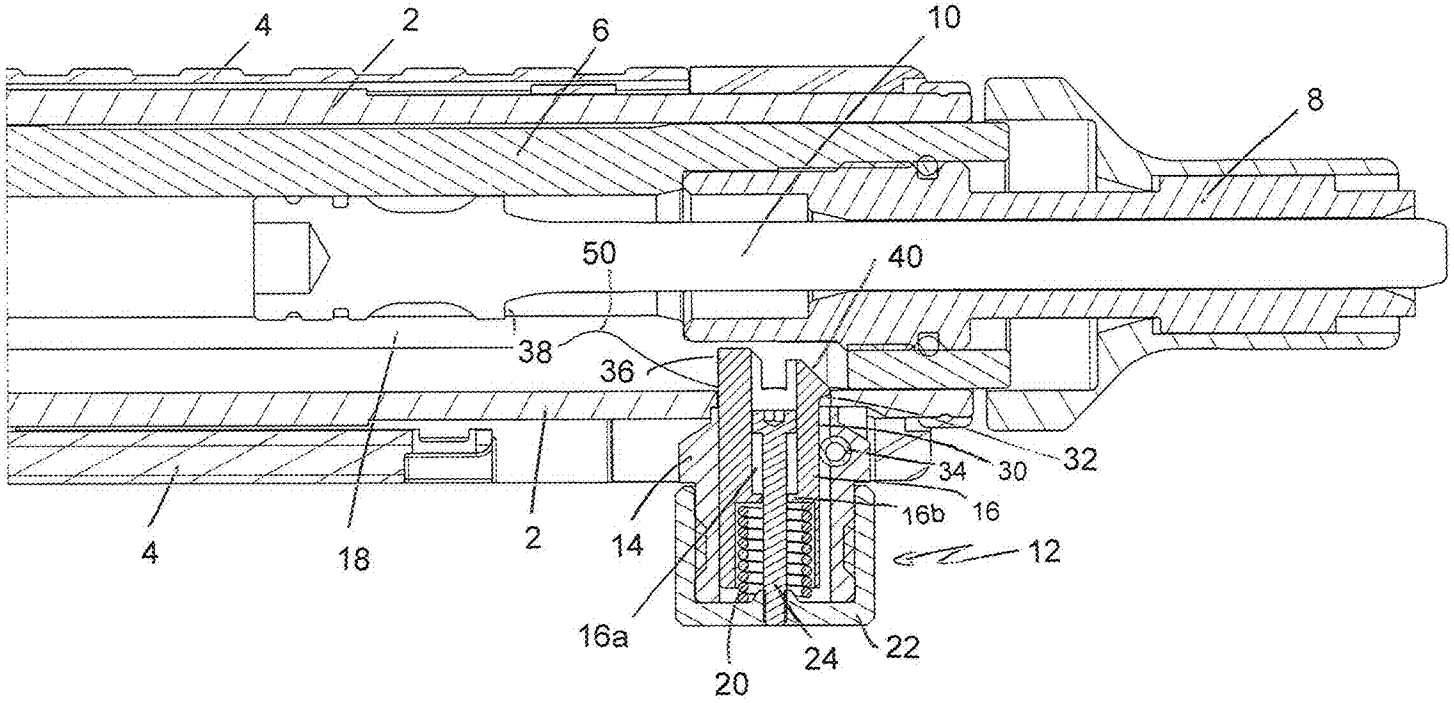
FIG. 1 is a section through the forward end portion of a tool in accordance with the preferred embodiment of the invention, the components being shown in a condition assumed immediately after firing the tool.

During normal operation of the tool, the cap 22 is screwed fully onto the spigot 14 as shown in FIG. 1, and the cap 22 is only unscrewed when it is required to remove the barrel as will be subsequently described. To facilitate its unscrewing for that purpose, the cap 22 is preferably knurled on its outer surface. The cap 22 is held captive relative to the pawl 16 by a bolt 24. The shank of the bolt 24 is fixed to the cap 22 by threaded engagement and extends into an interior passage 16*a* of the pawl so that the head of the bolt is above an internal partition 16*b* within the passage 16*a*. The configuration of the head of the bolt 24 within the passage 16*a* allows rotation of the cap 22 relative to the pawl 16 so as to permit the cap 22 to be unscrewed from the spigot 14 while permitting the pawl 16 to move axially relative to the spigot 14. As will be seen from FIG. 1, the shank of the bolt 24 extends axially through the compression spring 20 which is between the base of the cap 22 and the pawl 16.

The body of the retractor pawl 16 is of generally cylindrical shape of a diameter corresponding to the internal diameter of the spigot 14 so that the pawl 16 is a sliding fit within the spigot, but part of the outer cylindrical surface of the pawl 16 is cut back to form a flat face 30 which lies inwardly of the internal surface of the spigot. The flat face 30 is bounded from above by a shoulder 32 adjacent the head of the pawl. A roll pin 34 extending transversely through the wall of the spigot 14 engages the flat face 30. The roll pin 34 functions to prevent rotation between the pawl 16 and spigot 14 and thereby to ensure that the pawl 16 is retained in a predetermined angular orientation relative to the spigot 14 and ensures that the pawl 16 can only be installed in the correct orientation; it also acts as an abutment which is engaged by the shoulder 32 at the head end of the pawl when the cap 22 is unscrewed from the spigot 14 to permit removal of the barrel to ensure that in that condition the retractor pawl assembly is held captive to the receiver 2. Complete removal of the pawl assembly from the tool requires removal of the roll pin 34, an action requiring use of a tool (a punch for example) which would normally be undertaken in a workshop during servicing of the tool rather by an operator while using the tool on a work site.

The head of the retractor pawl 16 is of a width to extend into the longitudinal slot 18 formed in the forward end of the portion of the barrel 6 and includes a rearwardly-facing abutment surface 36 for engagement with a flange 38 of the drive piston 10 for resetting the piston as will be described, and a forwardly-facing ramped surface 40 for engagement with the piston 10 in an overdrive situation as will also be described. Part-cylindrical shoulders 42 at opposite sides of the head engage with the outer surface of the barrel 6 at either side of the slot 18 as may be clearly seen in FIG. 2. The outer surface of the barrel in the zone of the slot 18 acts as a cam surface engaged by the shoulders 42 and is profiled to control the radial position of the retractor pawl 16 relative to the barrel slot 18 when the barrel 6 is moved forwardly and rearwardly relative to the receiver 2 during operation of the tool.

Operation of the retractor pawl assembly will now be described commencing with FIG. 1 which shows the condition directly after firing. In this condition, the barrel 6 is in a rear position relative to the receiver 2 and the piston 10 is in a forward position in the barrel following driving of a fastener into the substrate from the fastener guide 8 at the forward end of the barrel 6. In this position of the barrel 6 relative to the receiver 2, the pawl 16 is held by the profile of the barrel 6 in that zone so that the pawl head is in a fully retracted position within the barrel slot 18.

Figure 4:
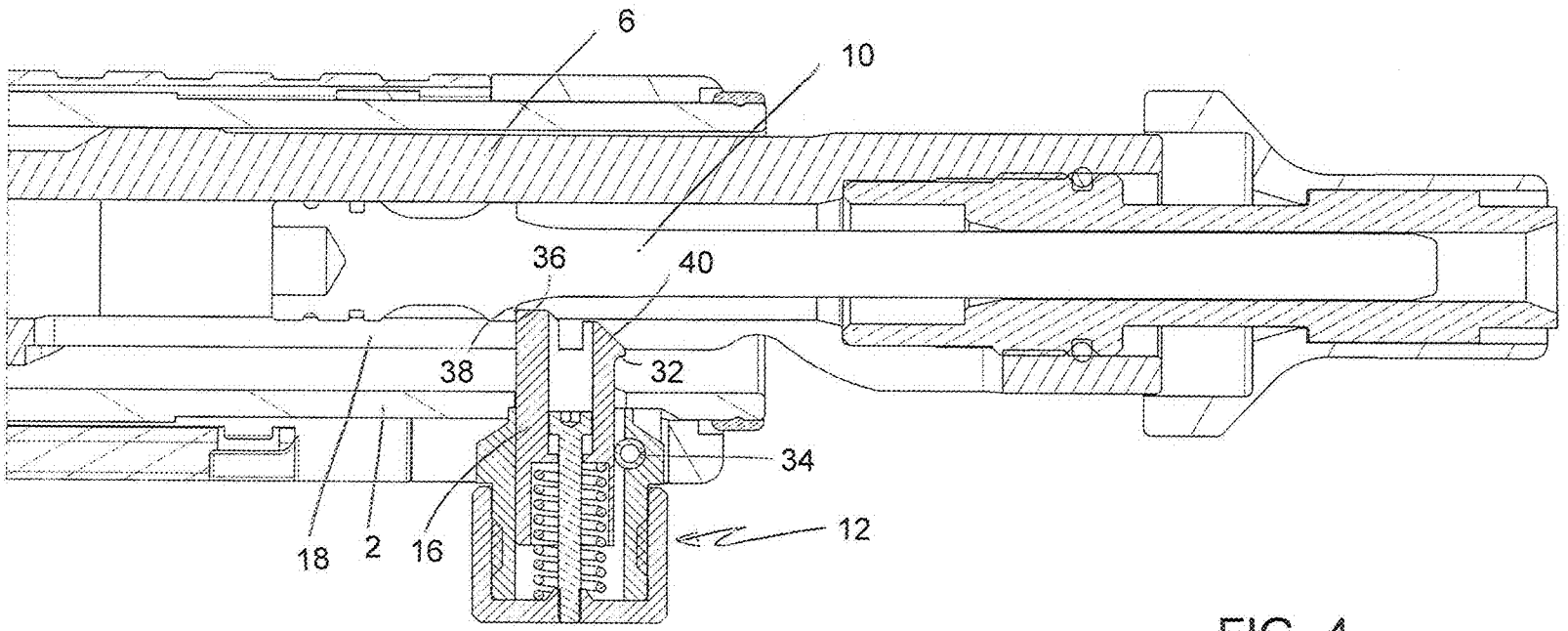
FIG. 4 is a section similar to FIG. 1 but showing the components in a condition during resetting of the piston to the rear of the barrel following firing.
Figure 5:
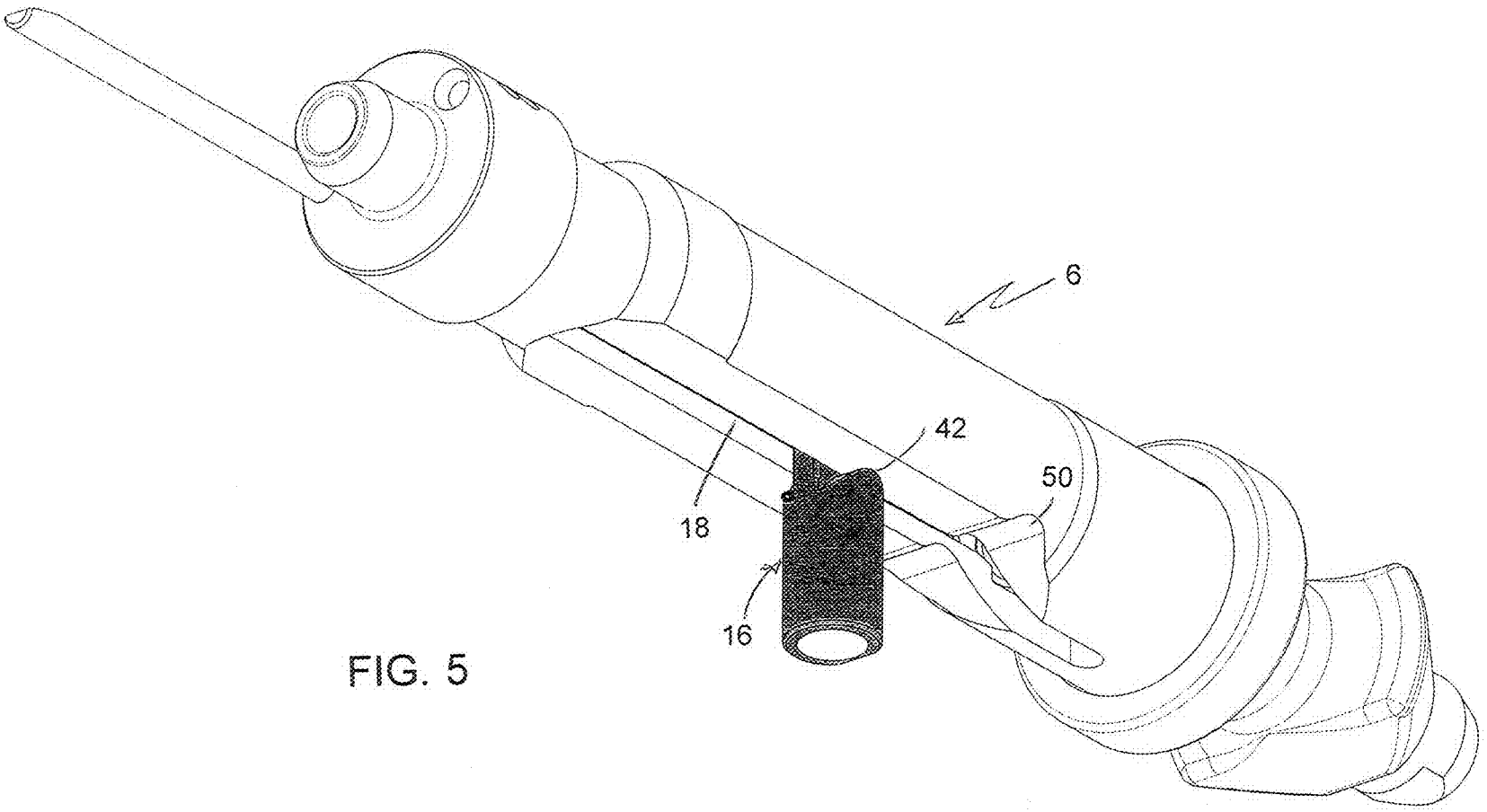
FIG. 5 is a schematic perspective view similar to FIG. 2 but showing the retractor pawl and barrel in the condition of FIG. 4.
Figure 6:
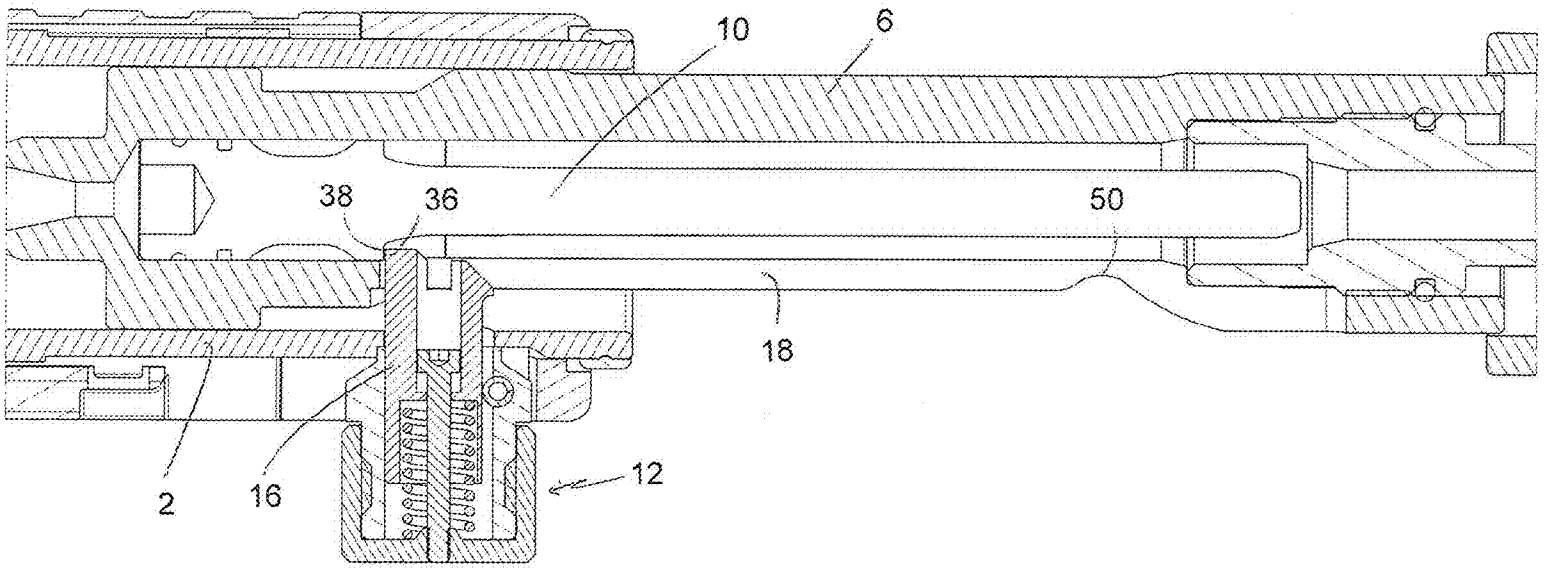
FIG. 6 is a section similar to FIG. 1 but showing the components in a condition in which the piston is fully reset to the rear of the barrel.

To reset the piston into the rear end of the barrel in preparation for the subsequent firing, the operator pulls the barrel forwardly or outwardly relative to the receiver. The shaping of the barrel surface at either side of the slot 18 allows the head of the pawl to displace inwardly under its spring bias into the interior of the barrel during this forward movement whereby its rear abutment surface 36 lies in the path of the forward flange 38 of the piston 10 to thereby engage and restrain the piston 10 from forward movement with the barrel. FIGS. 4 and 5 show the condition in which the head of the pawl has engaged and retained the piston 10 during the initial part of forwards barrel movement, and FIG. 6 shows the condition in which the piston 10 has been reset into the rear end of the barrel at the end of the forward movement of the barrel 6. The barrel 6 with the piston 10 thereby reset into its rear end can be pushed by the operator back into the receiver 2 in preparation for the next firing.

Figure 7:
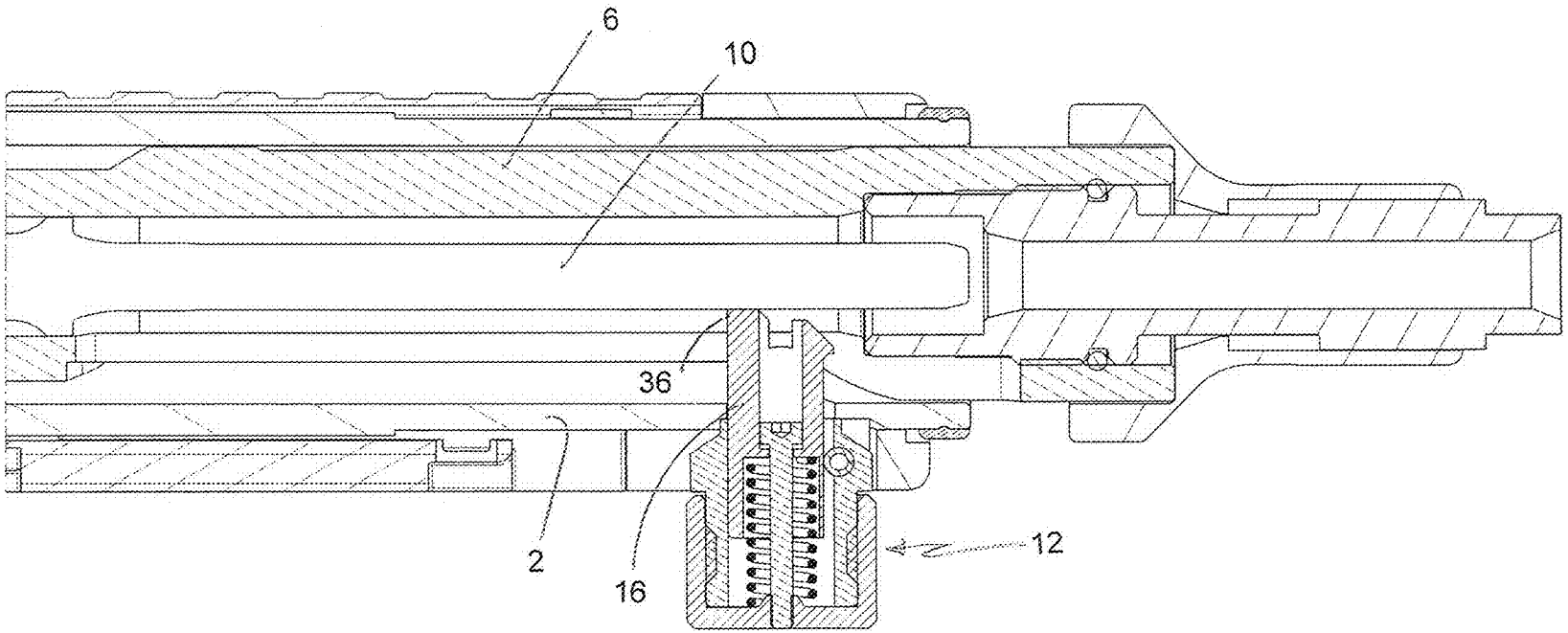
FIG. 7 is a section similar to FIG. 1 but showing the components in a condition assumed prior to firing of the tool.
Figure 8:
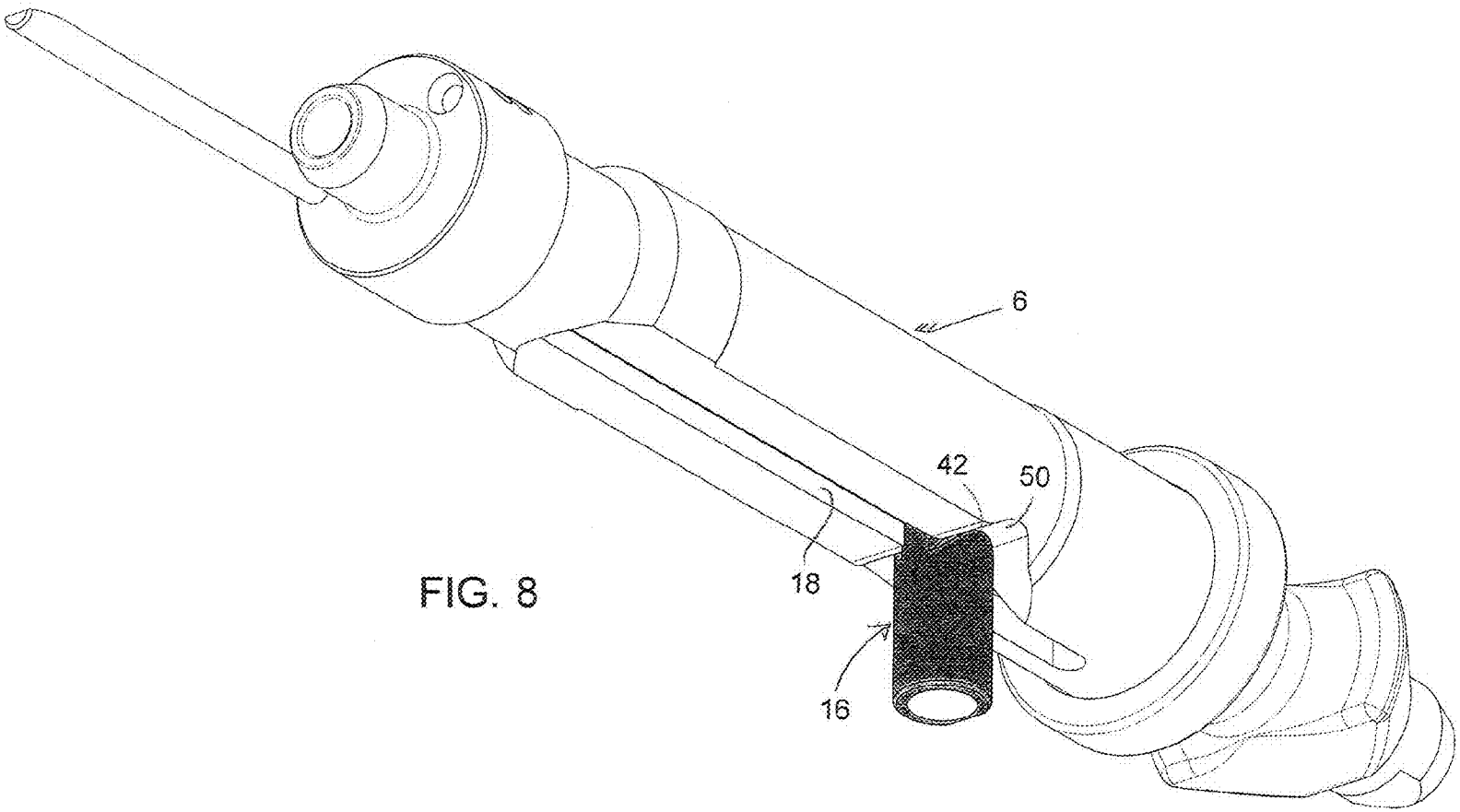
FIG. 8 is a schematic perspective view similar to FIG. 2 but showing the retractor pawl and barrel in the condition of FIG. 7.

In the ready-to-fire position of the barrel 6 in the receiver 2 (that is, the position assumed by the barrel prior to cocking the tool) as shown in FIGS. 7 and 8, the shoulders 42 of the pawl 16 engage within a detent groove 50 in the outer surface of the barrel 6 adjacent the forward end of the slot 18, and this prevents the barrel 6 from moving forwardly from the receiver 2 if the tool is lowered or perhaps as a result of inadvertent movement. While most tools of this type have a mechanism for preventing unwanted forwards movement of the barrel out of the ready-to-fire position, conventionally this is achieved by a mechanism which is separate from the retractor pawl assembly. The use of the retractor pawl also to prevent the unintended forwards movement of the barrel results in a simpler construction and a reduction in cost.

In order to fire the tool, the tool must be cocked and this is achieved by pressing the forward end of the fastener guide 8 against the substrate to push the barrel 6 further into the receiver from the position shown in FIGS. 7 and 8, and this occurs against the bias of a strong spring force provided by the firing mechanism. In the cocked condition, the barrel 6 and thereby the retractor pawl 16 are positioned as shown in FIG. 1 with the pawl retracted within the barrel slot 18 in a position where it is clearly held away from engagement with the piston during firing.

Figure 9:
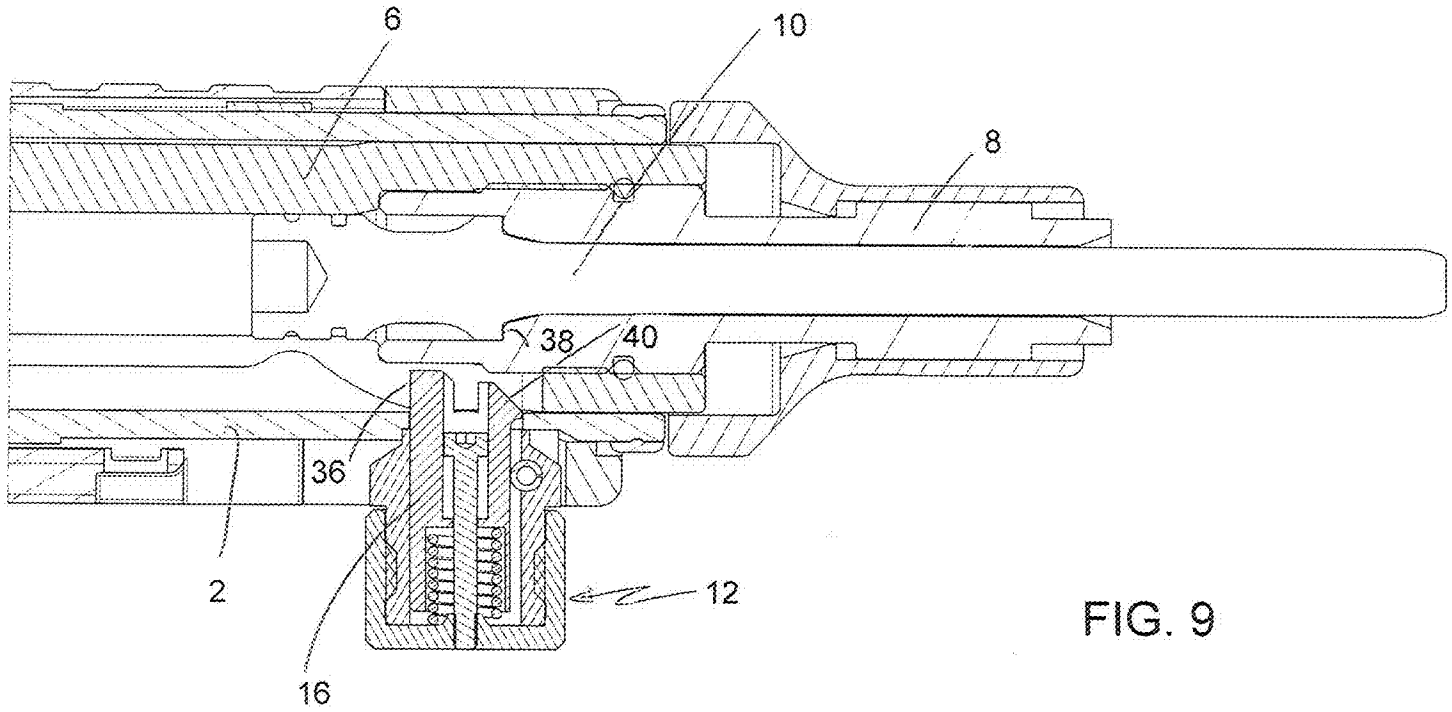
FIG. 9 is a section similar to FIG. 1 but showing the components in a condition assumed in overdrive of the piston.

FIG. 9 illustrates an overdrive situation which can occasionally occur if due to an error the operator uses the tool to drive a fastener into a soft substrate. In this overdrive condition, the rear end of the drive piston 10 is in engagement with the rear end of the fastener guide 8 in contrast to the normal position following firing as shown in FIG. 1 in which it is displaced rearwardly from the fastener guide and also rearwardly from the retractor pawl. In this overdrive condition, the relative positions of the retractor pawl 16 and the flange 38 of the piston 10 are such that the pawl 16 will not engage the flange 38 when the barrel 6 is drawn forwardly. If the barrel is drawn forwardly in this condition, subsequent rearwards displacement of the projecting end of the piston, for example by lightly tapping that end, will result in the rear edge of the piston riding over the ramped forward face 40 of the head of the pawl to retract the pawl against the bias of its compression spring until the piston is in a proper position within the barrel such that the rear abutment face 36 of the pawl head can engage the forward flange 38 of the piston in a normal resetting condition.

Figure 10:
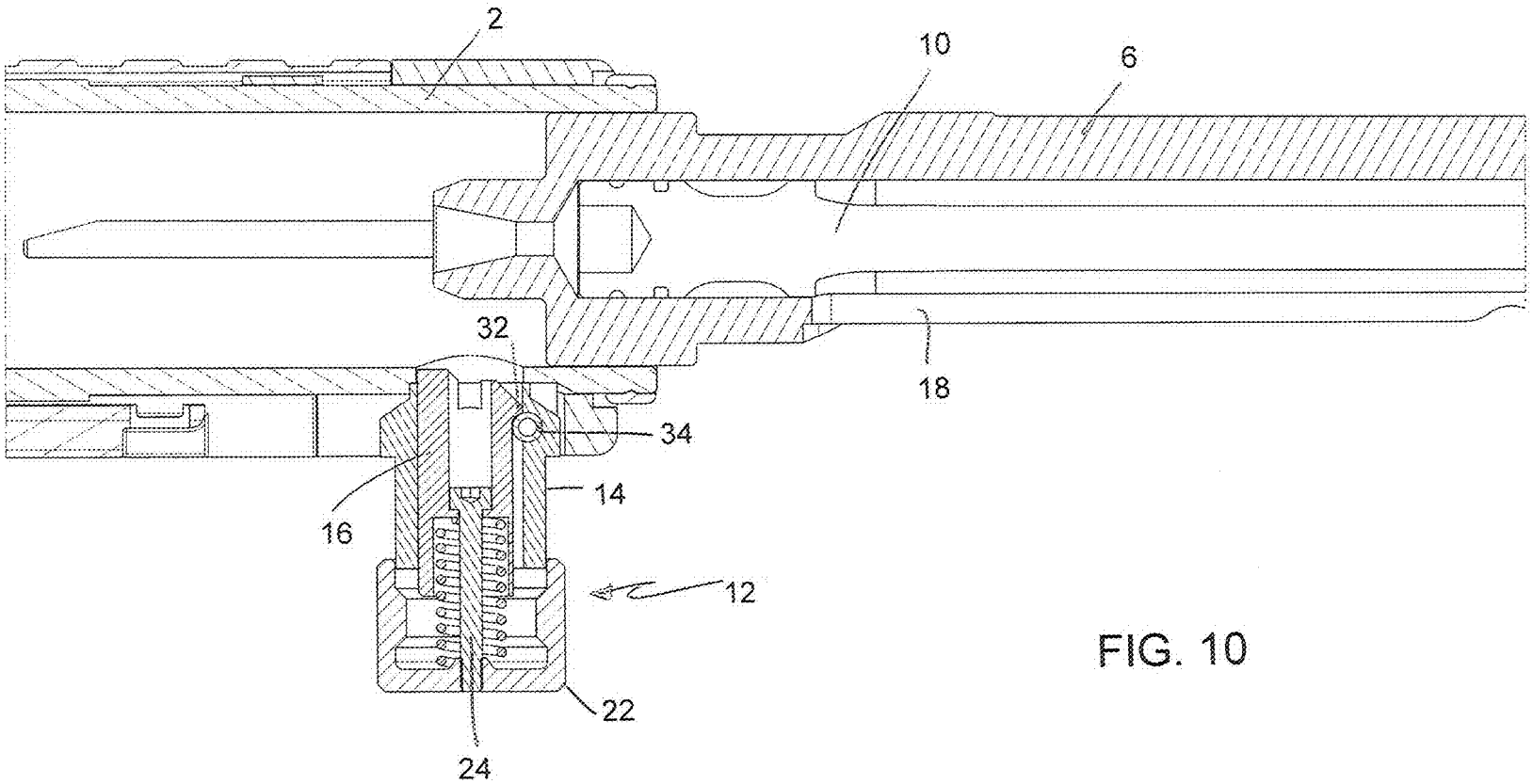
FIG. 10 is a section similar to FIG. 1 but showing the components in a condition in which the retractor pawl is fully released from the barrel to permit removal of the barrel from the receiver.

In order to remove the barrel 6 from the receiver 2, the pawl 16 must be fully retracted from the slot 18 in the barrel. This is simply achieved by unscrewing the cap 22 relative to the spigot 14. Unscrewing of the cap 22 causes the bolt 24 which is attached to the cap to draw the pawl 16 outwardly from the barrel slot (see FIG. 10). Withdrawal of the pawl 16 is limited by engagement of the pawl shoulder 32 with the roll pin 34 as shown in FIG. 10 and in this condition the cap 22 is disengaged from the thread of the spigot 14 so that the pawl 16 and the attached cap 22 are hanging from the roll pin 34. Accordingly, although in this condition the pawl 16 is fully retracted clear of the barrel, the pawl assembly still remains attached to the tool and cannot be removed except by removal of the roll pin 34. Thereby, the tool operator on a work site can be assured that unscrewing the cap to its fullest extent will retract the pawl fully to permit removal of the barrel, but the cap cannot be unscrewed to a point at which the pawl assembly will become detached from the tool itself. As the cap is knurled on its outer surface it is envisaged that an operator of the tool will intuitively appreciate that the cap needs to be unscrewed in order to permit removal of the barrel even if the operator is not especially familiar with this particular model of tool. The interaction between the roll pin and the flat face 30 of the pawl will ensure that the pawl is retained in the correct angular orientation to ensure that its head will re-enter the barrel slot when the barrel is returned to the tool.

Although in the embodiment shown, the cap 22 is held captive to the pawl 16 by the bolt arranged in the manner shown in which the head of the bolt slides within the interior of the pawl and the shank of the bolt is engaged with cap, in an alternative configuration the shank of the bolt may be engaged with the pawl with the head of the bolt being positioned externally of the cap so that the bolt can slide relative to the cap. While this latter configuration is technically feasible, it is not particularly preferred as it will result in the presence of the head end of the bolt projecting externally of the cap and moving inwardly and outwardly relative to the cap as the pawl displaces.

Although in the embodiment shown the cap is threadedly mounted to the spigot an alternative form of attachment, for example a bayonet type attachment, may be used. Other modifications are possible within the scope of the invention.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

The invention claimed is:

1. An explosively actuated fastener driving tool comprising a barrel mounted to a receiver of the tool, a driving piston within the barrel for driving a fastener at the forward end of the barrel upon firing of the tool, and a retractor pawl assembly for resetting the piston into a rear end of the barrel by forward movement of the barrel relative to the receiver following firing, wherein the retractor pawl assembly comprises a retractor pawl having a head including a shoulder adjacent thereto, wherein said head is extendible through a slot in the barrel to engage and retain the piston during forward movement of the barrel, the pawl being mounted in a housing fixed relative to the receiver and being spring biased to move radially into and out of the interior of the barrel by movement of the barrel relative to the receiver, and a release member operable to fully withdraw the pawl from the barrel to permit removal of the barrel from the receiver, the release member being mounted to the housing in such a manner that in a normal condition of the tool it cannot be moved to a position at which the pawl assembly is detached from the receiver, and a roll pin configured to engage said shoulder for retaining the pawl within the housing.

2. A tool according to claim 1, wherein the release member is accessible externally from the tool and is mounted to the housing for movement between a first position for normal operation of the tool and a second position in which the pawl is fully withdrawn from the barrel when removal of the barrel from the receiver is required.

3. A tool according to claim 2, wherein the second position is radially outwardly of the first position.

4. A tool according to claim 2, wherein the release member remains mounted to the housing when in its second position.

5. A tool according to claim 2, wherein the movement of the release member between its first and second positions includes a rotary component of movement.

6. A tool according to claim 5, wherein the release member is threadedly mounted to the housing for movement between its first and second positions.

7. A tool according to claim 1, wherein the release member is a cap accessible externally from the tool and rotatably mounted to the housing.

8. A tool according to claim 7, wherein the cap is threadedly mounted to the housing and the pawl is linked to the cap such that the pawl is withdrawn from the barrel slot when the cap is unscrewed relative to the housing, the cap remaining attached to the housing in the withdrawn condition of the pawl with the pawl remaining linked to the cap.

9. A tool according to claim 8, wherein the stop is removable using a tool, wherein the roll pin once removed from the retractor pawl assembly allows the cap with pawl linked thereto to be detached from the housing and removed.

10. A tool according to claim 8, wherein the pawl includes an abutment which engages the roll pin when the pawl is in its withdrawn position from the barrel.

11. A tool according to claim 8, wherein said pawl comprises a flattened face, and wherein the roll pin is engageable against said flattened face of the pawl to angularly locate the pawl relative to the barrel slot.

12. A tool according to claim 7, wherein a compression spring for providing the spring bias to the pawl is mounted within the interior of the cap to act between the cap and the pawl.

13. A tool according to claim 1, wherein in a ready-to-fire condition of the tool prior to cocking the tool, the pawl engages a detent in the barrel under its spring bias in order to retain the barrel against inadvertent forwards movement from the receiver.

14. An explosively actuated fastener driving tool of the type having a driving piston for driving a fastener at the forward end of a barrel upon firing of the tool, and a retractor pawl having a head including a shoulder adjacent thereto, wherein said head is extendible into the barrel for resetting the piston into a rear end of the barrel by forward movement of the barrel relative to the receiver following firing, wherein the pawl assembly is so constructed that the pawl can be withdrawn from the barrel to permit removal of the barrel for cleaning and maintenance while the pawl assembly remains attached to the tool to prevent components of the pawl assembly from being misplaced, wherein the pawl is mounted in a housing, and a roll pin configured to engage said shoulder for retaining the pawl within the housing.

* * * * *